US005155963A

United States Patent [19]

Woodman

[11] Patent Number: 5,155,963

[45] Date of Patent: Oct. 20, 1992

[54] LATTICE MOUNTING STRUCTURES

[76] Inventor: Richard C. Woodman, 2186 Ellwyn Dr., Atlanta, Ga. 30341

[21] Appl. No.: 645,217

[22] Filed: Jan. 24, 1991

[51] Int. Cl.[5] ..... E06B 9/24

[52] U.S. Cl. ..... 52/738; 160/392; 160/351; 52/208; 52/475

[58] Field of Search ..... 52/208, 475, 473, 738; 160/392, 395, 351

[56] References Cited

U.S. PATENT DOCUMENTS

| | | | |
|---|---|---|---|
| 935,190 | 9/1909 | Conover . | |
| 1,376,150 | 4/1921 | Miller . | |
| 1,591,328 | 7/1926 | Lachman | 160/392 |
| 1,776,785 | 9/1930 | Davidson . | |
| 2,335,361 | 11/1943 | Schiller | 160/395 |
| 2,505,893 | 5/1950 | Haas | 52/208 |
| 2,762,475 | 9/1956 | Bowden . | |
| 2,840,869 | 7/1958 | Fegan . | |
| 3,093,217 | 6/1963 | Doede . | |
| 3,371,454 | 3/1968 | Anderson . | |
| 3,405,489 | 10/1968 | Frisk . | |
| 3,442,059 | 5/1969 | Kessler | 52/475 |
| 3,524,491 | 8/1970 | Olson . | |
| 3,720,438 | 3/1973 | Johnson et al. . | |
| 4,057,095 | 11/1977 | Hirota | 160/395 |
| 4,483,113 | 11/1984 | Kruschwitz | 52/208 |
| 4,690,383 | 9/1987 | Batcheller . | |
| 4,800,601 | 1/1989 | DeCaro . | |
| 4,830,080 | 5/1989 | Densen | 160/351 |
| 4,905,970 | 3/1990 | Holmsten et al. . | |
| 4,987,699 | 1/1991 | Gold | 52/208 |

FOREIGN PATENT DOCUMENTS

| | | | |
|---|---|---|---|
| 2359972 | 7/1975 | Fed. Rep. of Germany | 160/351 |

*Primary Examiner*—Richard E. Chilcot, Jr.
*Assistant Examiner*—Joanne C. Downs
*Attorney, Agent, or Firm*—Kilpatrick & Cody

[57] ABSTRACT

A vinyl lattice panel mounting structure of aluminum comprising a channel fixed to or formed as a part of a panel supporting structure member and a fixing strip for engagement with the vinyl lattice panel edge which is received in the channel and resists withdrawal of the panel edge from the channel.

10 Claims, 4 Drawing Sheets

LATTICE MOUNTING STRUCTURES

BACKGROUND OF THE INVENTION

Lattice-work fencing and screening structures in a variety of patterns have been used throughout human history and continue to be important functional and decorative components of architecture, furniture, decorative arts and fencing. While lattice constructed of wood and other conventional materials has long been in use, such structures utilizing polyvinyl chloride and other synthetic components are, of course, of far more recent origin. Vinyl lattice offers a variety of desirable attributes, including substantial weather resistance and durability, a wide range of colors, substantially greater uniformity of appearance and strength as compared to wood and economic benefits as compared to alternative structures for utilization in the same applications. Vinyl lattice does, however, present certain challenges in installation. Prominent among those is the significant temperature coefficient of expansion of vinyl which means that large vinyl lattice panels exhibit significant dimensional differences across a typical range of temperatures experienced in outdoor applications (on the order, for instance, of three-eighths of an inch across a panel). As a result, installation techniques and fixtures able to accommodate such dimensional variations while adequately fixing the lattice in place are desirable.

Furthermore, the desirable aesthetics, durability and strength attributes of vinyl lattice make it preferable to utilize mounting structures having similar properties.

SUMMARY OF THE INVENTION

The present invention provides a durable, strong, weather-resistant method and apparatus for installation of vinyl lattice, particularly in outdoor applications, by providing a two-component aluminum fixture positioned along the lattice edges. A first component or channel is fixed to, or formed as an integral part of, a structural component such as a hand rail, bottom rail or post, and this channel receives a peripheral lattice edge or fixing strip. The fixing strip is affixed to or grips the lattice edge and is captured within the channel in such a way that movement of the lattice edge in response to dimensional changes is permitted, but complete withdrawal of the lattice edge from the channel is resisted.

A first embodiment of the present invention comprises a channel having a generally square or rectangular, hollow cross-section with an intermediate longitudinal portion of one channel side omitted to form a "throat" defined by the remaining portions of such wall. A Z-shaped fixing strip is fixed to the lattice edge with brads, screws, adhesive or other appropriate means and is then threaded or telescoped into the channel. The upper and lower "legs" of the Z-shaped fixing strip limit movement of the lattice edge normal to its surface, and the lower leg prevents the lattice from pulling out of the channel by stopping against one of the throat-defining portions of channel wall, while permitting a desired amount of movement within the channel as the lattice dimensions change in response to temperature changes.

In an alternative embodiment of the present invention, a more complex interior channel geometry is utilized together with a fixing member which is generally U-shaped with inward-sloping ramps on the open end of each "arm" of the "U," culminating in sharp edges so that the fixing strip can be forced over the edge of the vinyl lattice by causing the strip arms to spread. The sharp edges then dig into the lattice surface in order to hold the fixing strip in place.

The interior geometry and dimensions of the channel and the exterior geometry and dimensions of the fixing strip cooperate to make it possible for the fixing strip to be placed within the channel and then for its arms to spread as a lattice edge is inserted through the channel throat and into the fixing strip. The relative geometry and dimensions also permit the fixing strip to move within the channel in response to lattice dimensional changes but prevent its removal from the channel through the channel throat. Interior ramp surfaces sloping away from the channel throat prevent extraction of the fixing strip from the throat and urge fixing strip arms together in response to movement of the lattice edge tending to withdraw it from the channel, thereby causing the fixing strip edges to grip the lattice more firmly.

The channel of the present invention may be fabricated as a separate member to be affixed to a hand rail, bottom rail, post or other structure to which lattice is to be mounted. "Feet" on such a separate channel opposite its throat will facilitate mounting the channel on curved structural members. The channel of either embodiment may also be formed as an integral part of structural members. For instance, an aluminum hand rail or other structural member such as a porch post may be formed containing one or more channels.

It will typically be desirable to utilize dimensions for the channel to be used for the upper peripheral edge of a lattice panel that will substantially limit movement of that panel edge into and out of the channel, so that the panel is effectively suspended from the upper channel of a lattice panel assembly and the side and lower lattice panel edges "float" within their respective channels.

DETAILED DESCRIPTION OF THE DRAWINGS

Figure 1:
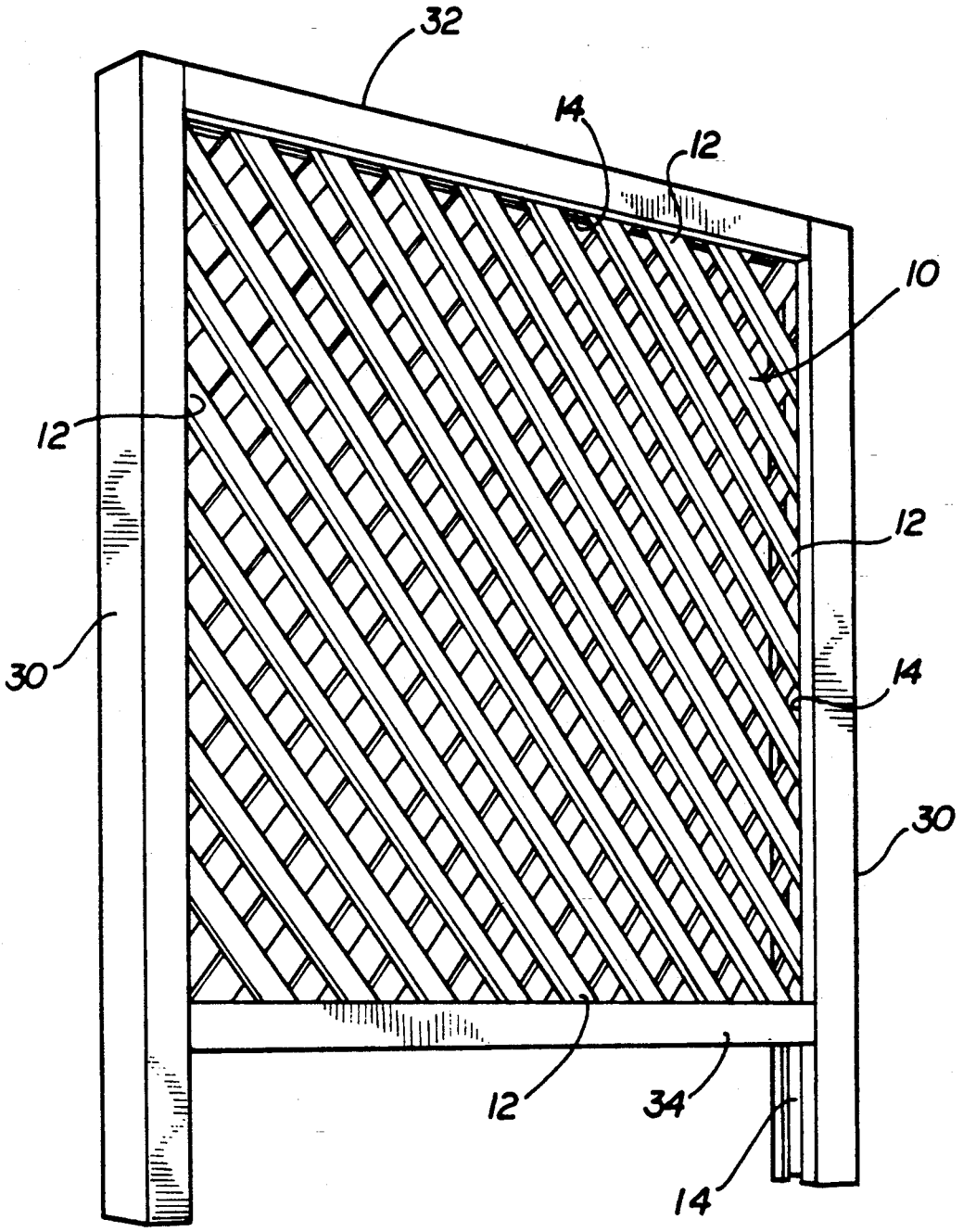
FIG. 1 is a perspective view of a typical lattice panel shown positioned within mounting structures that engage the panel edges.

FIG. 1 shows a typical lattice panel 10 fixed at its peripheral edges 12 in mounting structures 14 attached to posts 30, a top rail 32 and bottom rail 34.

Figure 2:
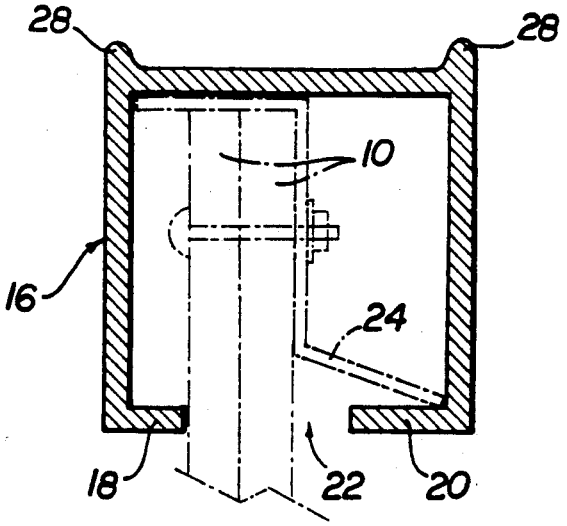
FIG. 2 is a cross-section view of a channel of a first embodiment of the present invention.
Figure 3:
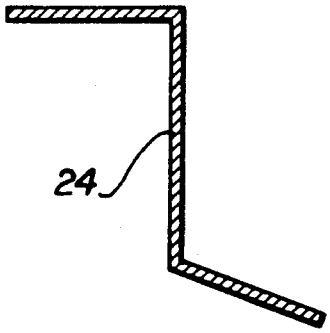
FIG. 3 is a cross-section view of a Z-shaped fixing strip utilized with the channel shown in FIG. 2.
Figure 4:
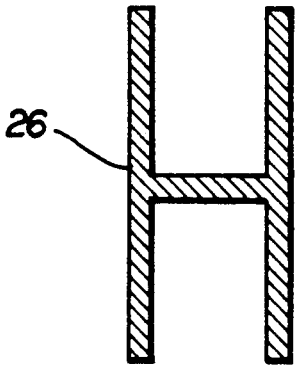
FIG. 4 is a cross-section view of an H-shaped channel used as an intermediate panel-joining member with the channel and fixing strip shown in FIGS. 2 and 3, respectively.

The components of the first embodiment of the mounting structure 14 of the present invention are illustrated in FIGS. 2–4.

FIG. 2 shows a cross-section of a channel 16 generally having the shape of a hollow rectangle with a portion of one rectangle side omitted, leaving a short wing 18 and longer wing 20 that define an opening or throat 22. A Z-shaped fixing strip 24 is affixed to a peripheral edge 12 of a panel 10 utilizing brads, screws, adhesive or other appropriate means (none of which are shown).

After affixing fixing strip 24 to an edge 12 of lattice panel 10, fixing strip 24 is threaded into channel 16.

As will be readily understood by one skilled in the art, channel 16 will previously have been affixed to the structure to which lattice panel 10 is being mounted with screws or other appropriate means or, alternatively, channel 16 may have been formed as a part of such structure.

H-shaped intermediate panel-joining member 26 can receive opposed edges 12 of adjacent panels 10. By choosing an exterior dimension for panel-joining member 26 slightly smaller than the width of throat 22 of channel 16, panel-joining member 26 may extend into channel 16 (oriented at right angles to channel 16).

Where channel 16 is separate from structural members and such structural members are curved, channel 16 may be formed with "feet" 28 having appropriate dimensions to allow channel 16 to be firmly fixed against such curved structural members without rocking.

Figure 5:
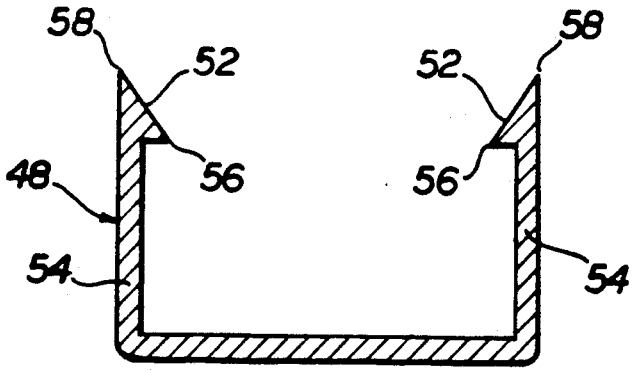
FIG. 5 is a cross-section view of the U-shaped fixing strip of the second embodiment of the present invention.
Figure 6:
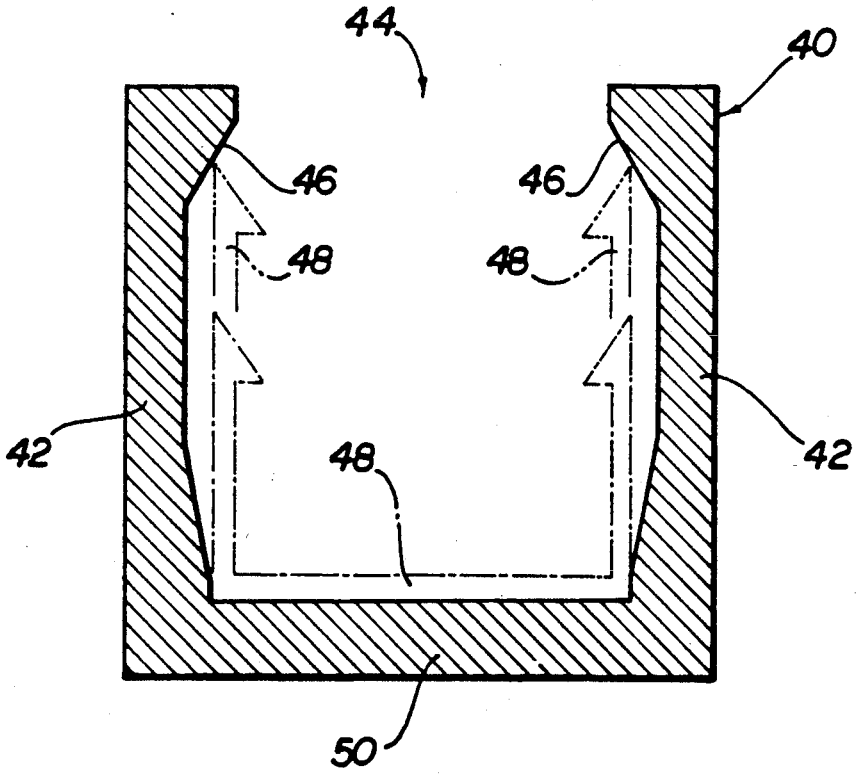
FIG. 6 is a cross-section view of the U-shaped channel of the second embodiment of the present invention with alternative positions of the fixing strip of FIG. 5 shown within the channel in broken lines.

FIGS. 5–7 illustrate the second embodiment of the present invention. This embodiment utilizes a U-shaped channel 40, illustrated in cross-section in FIG. 6, which, like the other components described here, may typically be formed of extruded aluminum. U-shaped channel 40 has arms 42 that define a throat 44 through which panel 10 is inserted. Throat ramp surfaces 46 slope away from the throat. A generally U-shaped fixing strip illustrated in cross-section in FIG. 5 is utilized with channel 40. Alternative positions of fixing strip 48 within channel 42 are indicated in dotted lines in FIG. 6.

During assembly, fixing strip 48 would normally lie against the bottom 50 of channel 42, and edge 12 of lattice panel 10 would be inserted through the throat 44 of channel 40 and, by bearing against ramp surfaces 52 of fixing strip 48, force the arms 54 of fixing strip 48 apart to admit panel 10 edge 12 between arms 54. Panel surfaces would be engaged by the sharp edges 56 at the bottom of fixing strip 48 ramp surfaces 52. Movement of panel 10 tending to withdraw its edge 12 from channel 40 would cause the corners 58 of fixing strip 48 to bear against channel 40 ramp surfaces 46, thereby closing fixing strip 48 arms 54 and causing edges 56 to grip panel edge 12 more tightly, while resisting withdrawal of fixing strip 48 from channel 40.

As described above, the length of channel arms 42 may be reduced in a channel 40 used at the top of a lattice assembly, so that the lattice panel 10 will be suspended and its other edges 12 may "float" in their respective channels 40.

Figure 7A:
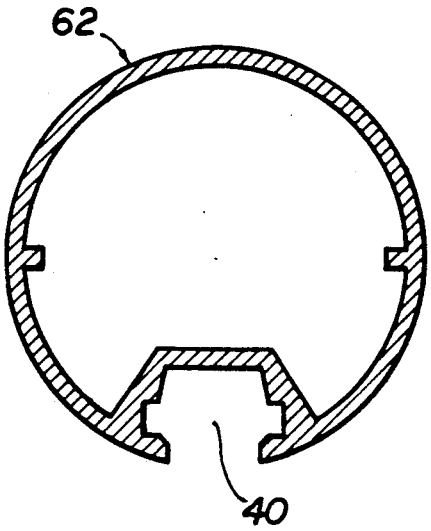
FIG. 7A, B, C, D and E are cross-section views of channels of the second embodiment of the present invention similar to the channel shown in FIG. 6, where such channels are formed as integral parts of a top rail, end post, corner post, line post, and bottom rail, respectively.
Figure 7B:
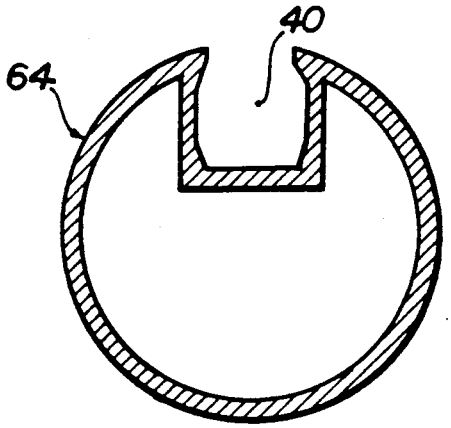
Figure 7C:
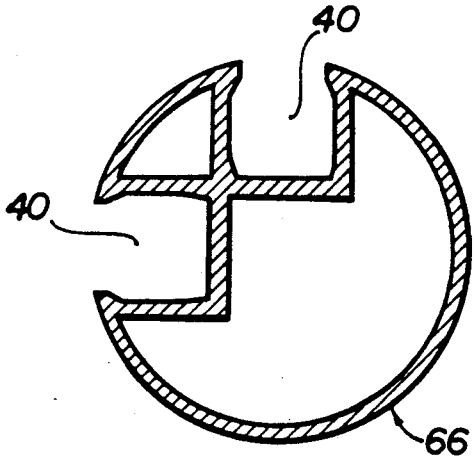
Figure 7E:
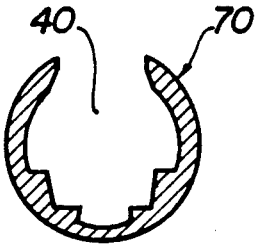
Figure 7D:
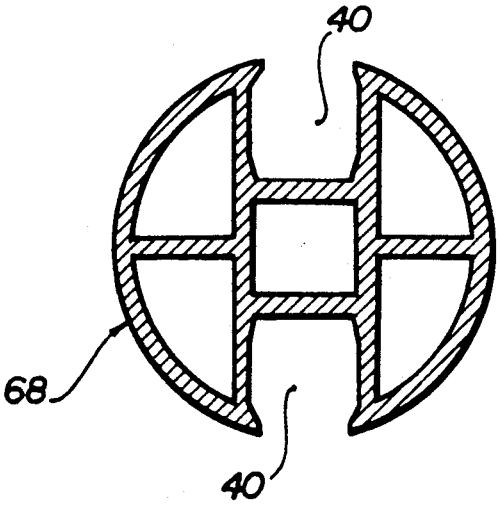

As will be readily understood by those skilled in the art, channel 40 may be incorporated in structural members such as top rail 62, end post 64, corner post 66, line post 68 or bottom rail 70 illustrated in FIGS. 7A, B, C, D and E, respectively. It will be noted that channel 40 in top rail 62 shown in FIG. 7A is not as deep as the other channels 40 illustrated in FIG. 7, so that less movement of panel 10 edge 12 within a top rail channel is permitted.

The foregoing description of this invention is for purposes of explanation and illustration. It will be apparent to those skilled in the art that modification and changes may be made to this invention as thus described without departing from its scope and spirit.

I claim:

1. An assembly for mounting vinyl lattice panels comprising a channel having an interior and a throat and a fixing strip movably positioned in the channel interior for engaging an edge of the panel and for resisting withdrawal of the panel edge through the throat when the fixing strip is engaged with the panel edge.

2. An assembly for mounting a vinyl lattice panel having at least one edge that allows the panel to expand and contract in response to changes in temperature, comprising:

a) a generally U-shaped channel having an interior and a short wing and a long wing defining a throat; and b) a generally Z-shaped fixing strip that is affixed to a first edge of the panel and is threaded into the interior of the channel.

3. The assembly of claim 2 further comprising a means to firmly fix the channel against a curved structural member without rocking.

4. The assembly of claim 2 further comprising a generally H-shaped panel joining member received on a second edge of the panel.

5. The assembly of claim 4 wherein the channel, fixing strip and panel joining member comprise aluminum.

6. An assembly for mounting a vinyl lattice panel having at least one edge that allows the panel to expand and contract in response to changes in temperature, comprising:

a) at least one generally U-shaped channel having an interior and a throat defined by inwardly sloping ramps; and b) at least one generally U-shaped fixing strip having arms with inwardly projecting sharp edges that is received in the interior of the channel.

7. The assembly of claim 6 wherein the channel is incorporated in a structural member.

8. The assembly of claim 7 wherein the structural member is a post.

9. The assembly of claim 7 wherein the structural member is a rail.

10. The assembly of claim 7 wherein the channel, structural member and the fixing strip comprise aluminum.

* * * * *